United States Patent [19]

Ehlich et al.

[11] 3,996,842

[45] Dec. 14, 1976

[54] APPARATUS FOR REDUCING AND EQUALIZING LOCALIZED STRESSES IN RUNNING PAPER WEBS OR THE LIKE

[75] Inventors: Klaus-Dieter Ehlich; Heinz-Christen Lorenzen, both of Hamburg, Germany

[73] Assignee: Hauni-Werke Korber & Co., KG, Hamburg, Germany

[22] Filed: Apr. 17, 1975

[21] Appl. No.: 569,195

[30] Foreign Application Priority Data

May 3, 1974 Germany ..... 2421394
Jan. 1, 1975 Germany ..... 2500955

[52] U.S. Cl. ..... 93/1 R; 162/255; 162/271

[51] Int. Cl.[2] ..... B31F 7/00

[58] Field of Search ..... 162/270, 271, 197, 193, 162/255; 93/1 R; 242/186

[56] References Cited

UNITED STATES PATENTS

| | | | |
|---|---|---|---|
| 2,339,070 | 1/1944 | Hayes | 162/270 X |
| 2,737,089 | 3/1956 | Baumgartner | 162/271 |
| 2,806,412 | 9/1957 | Gurley et al. | 162/271 X |
| 2,918,897 | 12/1959 | Zernov | 162/197 X |
| 2,963,087 | 12/1960 | Eichorn et al. | 162/271 X |
| 3,185,616 | 5/1965 | Zernov et al. | 162/271 |

*Primary Examiner*—James F. Coan
*Attorney, Agent, or Firm*—Peter K. Kontler; John Kurucz

[57] ABSTRACT

A filter cigarette making machine wherein the web which is to yield adhesive-coated uniting bands is flexed by a curling device before it reaches the paster. The curling device is rigid with or is movable relative to a supporting device which is mounted in the frame of the filter cigarette making machine. A safety device can be activated to disengage the web from the curling device during starting of the web and/or to temporarily disengage the web from the curling device when a splice in the web approaches the curling station. The safety device has a rod which can bodily disengage the web from the edge of the curling device or a shaft which can rotate the supporting device to thereby move the curling device out of the way.

16 Claims, 12 Drawing Figures

Fig. 10
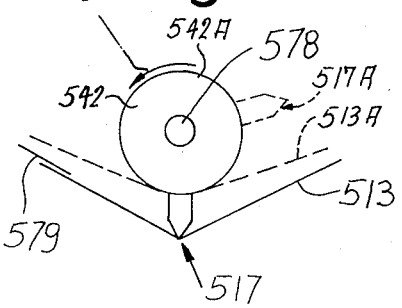
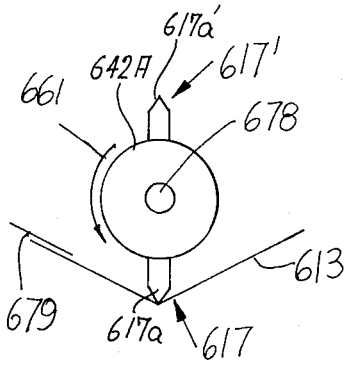
Fig. 11
Fig. 12
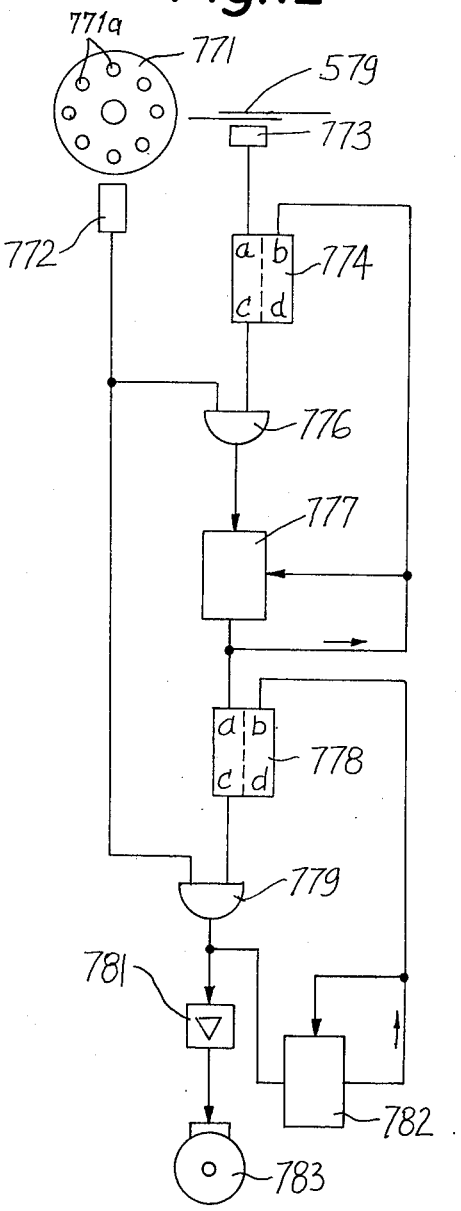

APPARATUS FOR REDUCING AND EQUALIZING LOCALIZED STRESSES IN RUNNING PAPER WEBS OR THE LIKE

CROSS-REFERENCE TO RELATED APPLICATION

Certain curling bars which are described in the present application are identical with or similar to those disclosed and claimed in the commonly owned application Ser. No. 504,757 filed Sept. 10, 1974, now U.S. Pat. No. 3,962,957 by Alfred Hinzmann.

BACKGROUND OF THE INVENTION

The present invention relates to apparatus for manipulating elongated flexible webs, particularly for reducing and/or equalizing localized stresses in running webs consisting of paper, imitation cork, reconstituted tobacco, lightweight cardboard, synthetic plastic materials or the like. Still more particularly, the invention relates to apparatus for manipulating running webs in filter cigarette making or like machines wherein a web is coated with adhesive at one of its sides and convoluted around rod-like tobacco filters, filter rod sections and/or plain cigarettes, cigarillos or cigars, for example to form filter cigarettes, cigarillos or cigars of unit length or multiple unit length.

A web of relatively still paper, imitation cork or like flexible material is normally treated by a so-called curling device (often called curling bar) prior to draping around filter material and/or wrapped or unwrapped rod-like tobacco filters. The purpose of the curling device is to reduce localized stresses and/or to reduce or eliminate differences in the length of longitudinally extending strip-shaped portions of webs. Reference may be had to the aforementioned copending application Ser. No. 504,757 which describes conventional (fixedly mounted) as well as several novel (movable or yieldable) curling devices and the manner in which such curling devices contribute to reduction or elimination of localized stresses and/or differences in length of longitudinally extending portions of webs made of paper, imitation cork or the like. The curling device also serves to reduce the stiffness of the running web so that the latter can be readily coiled around a rod-like filler or around two or more wrapped rod-shaped article. The curling device employs a relatively sharp elongated web-contacting or web-engaging member which bears against one side of the running web and flexes successive increments of the web, preferably before the thus treated side is coated with adhesive paste. The flexing and resulting softening of running web is desirable because such web can be readily converted into a tube which sealingly surrounds the joint between a filter rod section of unit length and a plain cigarette, cigar or cigarillo of unit length of between a filter rod section of double unit length and two plain cigarettes, cigars or cagarillos of unit length, depending upon whether the machine is to produce filter cigarettes, cigars or cigarillos of unit length or multiple unit length. However, proper flexing and curling of the web is insured only if the web bears against the curlng device with a certain force which is likely to result in damage to (particularly breaking or tearing of) the web during acceleration of the web and/or when a weakened or defective portion of the web travels past the web-contacting member of the curling device. Such weakened or defective portions of webs include splices which are used to connect the trailing portion of an expiring web to the leader of a fresh web as well as web portions which are weak due to malfunction of the machine which makes the web.

SUMMARY OF THE INVENTION

An object of the invention is to provide an apparatus which includes one or more curling devices for a running web of relatively stiff paper, imitation cork or the like and which further includes means for preventing such damage to the web which could occur if the web were to engage the curling device during certain critical stages of its movement and/or owing to engagement between the curling device and defective (e.g., weakened) portion of the web.

Another object of the invention is to provide an apparatus which can automatically terminate or prevent the engagement between a running web and the curling device when the speed of the web changes, i.e., when the speed of the web is without a predetermined range of satisfactory speeds.

A further object of the invention is to provide an apparatus which can automatically terminate the engagement between a running web and the curling device when the curling device is approached by a defective portion of the web.

An additional object of the invention is to provide an apparatus which includes a curling device and is capable of preventing tearing or breaking of the web by the curling device, not only when the speed of the running web is such that the web would be likely to break in response to engagement with and resulting flexing by the curling device but also when the running web would be likely to break as a result of flexing of a damaged web portion.

The invention is embodied in an apparatus for manipulating an elongated flexible web, particularly a web which is being withdrawn from a bobbin and is utilized in the manufacture or processing of smoker's products. The apparatus comprises means for advancing the web lengthwise in a predetermined direction along a predetermined path, a supporting device which is adjacent to one side of the path, at least one curling device mounted on or in the supporting device and having an elongated web-contacting or web-engaging member which extends substantially transversely of the path and normally engages the one side of the web so that successive increments of the advancing web are flexed as a result of engagement with the web-contacting member, a safety device which is actuatable to disengage the web from the curling device (this can be effected by moving the web out of contact with the web-contacting member and/or vice versa), and control means for actuating the safety device.

The apparatus preferably further comprises means for operating the advancing means at a plurality of speeds, and the control means may comprise means for monitoring the speed of the advancing means and means for effecting the actuation of safety device (i.e., disengagement of the web from the web-contacting member of the curling device) when the monitored speed of the advancing means deviates from a predetermined speed range at which the web is not likely to break in response to engagement with the curling device.

The web may comprise spaced-apart defective portions (e.g., weakened portions which develop due to manfunctioning of the machinery for making of the web and/or which constitute splices between an expiring web and a fresh web). The control means may comprise means for monitoring the web ahead of the curling device to detect defective portions of the web and means for effecting preferably temporary actuation of the safety device in response to detection of defective portions by the monitoring means so that such defective portions are not engaged by the web-contacting member of the curling device.

The safety device may comprise a discrete element which is shiftable by an electromagnet or the like to disengage the web from the web-contacting member of the curling device, or a shaft which can rotate the supporting device and the curling device so that the web-contacting member of the curling device is moved out of engagement with the running web.

The curling device may be fixedly mounted in, or it may be pivotable or otherwise movable relative to the supporting device.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

BRIEF DESCRIPTION OF THE DRAWING

FIG. 10 is a schematic elevational view of a portion of a modified safety device which can rotate the supporting device and the curling device about a fixed axis;

FIG. 11 is a similar view of a modification of the structure shown in FIG. 10; and FIG. 12 is a diagrammatic view of control means for the safety device a portion of which is shown in FIG. 10.

DESCRIPTION OF THE PREFERRED EMBODIMENTS

Figure 1:
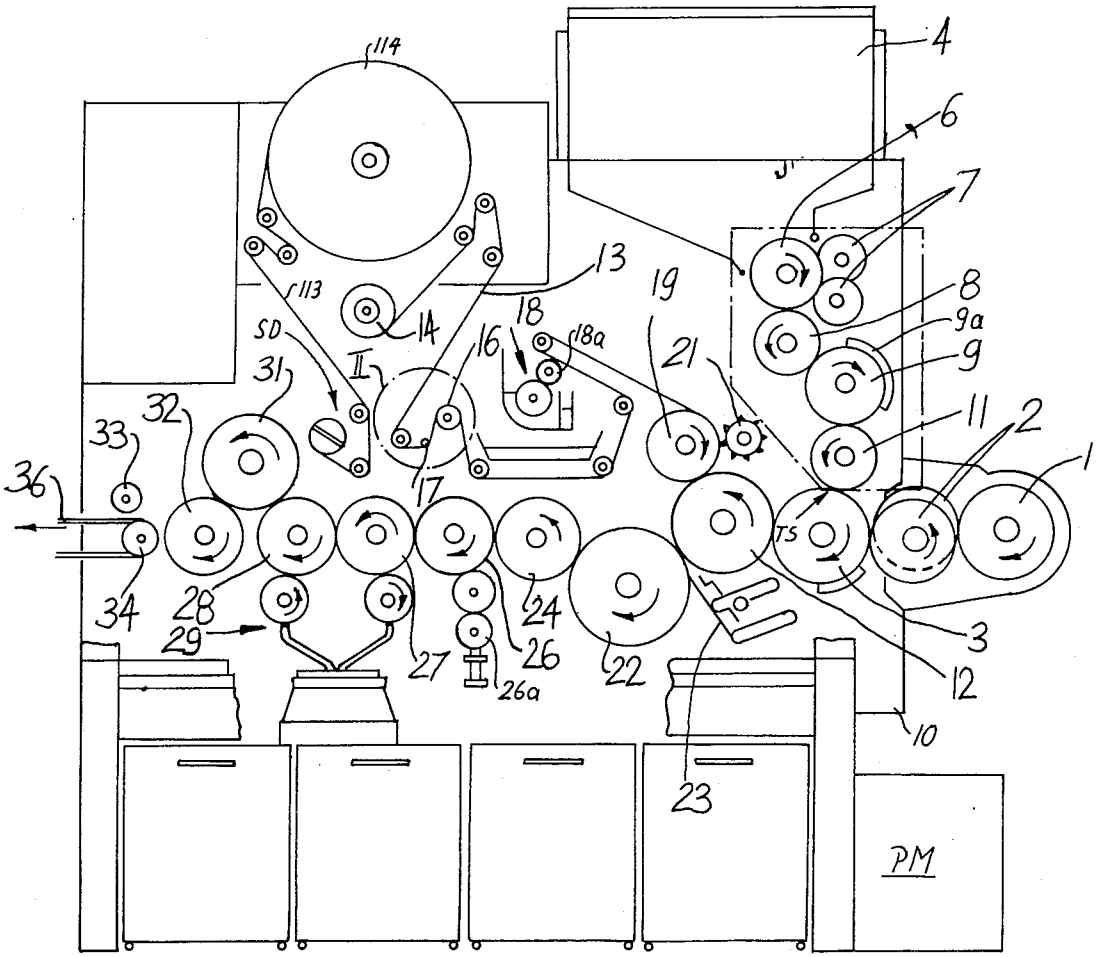
FIG. 1 is a schematic elevational view of a filter cigarette making machine which embodies the improved web manipulating apparatus.

FIG. 1 shows a filter cigarette making machine known as MAX-S produced by Hauni-Werke Körber & Co. KG, Hamburg-Bergedorf, Western Germany. This machine is merely an example of machines which can embody the apparatus of the present invention.

The machine of FIG. 1 is directly coupled with a cigarette rod making machine which supplies a succession of plain cigarettes of unit length to a rotary drum-shaped conveyor 1 shown in the right-hand portion of FIG. 1. The conveyor 1 is mounted in the frame 10 of the filter cigarette making machine but it can be considered a component part of the cigarette rod making machine. This conveyor has flutes which are machined into or attached to its periphery and extend in parallelism with its axis. The cigarette rod making machine feeds plain cigarettes of unit length into successive flutes of the conveyor 1 but the cigarettes in the first, third, fifth, etc. flutes are staggered with respect to cigarettes in the second, fourth, sixth, etc. flutes so that the conveyor 1 carries two rows of plain cigarettes of unit length which are respectively transferred into successive flutes of two discrete rotary drum-shaped aligning conveyors 2 in the frame 10. The aligning conveyors 2 rotate at different speeds and/or transport the cigarettes of the respective rows through different distances so that each plain cigarette of one row is aligned with a plain cigarette of the other row when the cigarettes are transferred into successive flutes of a rotary drum-shaped assembly conveyor 3 in the frame 10 of the filter cigarette making machine. Immediately following the transfer from aligning conveyors 2, the pairs of cigarettes in the flutes of the assembly conveyor 3 are spaced apart so that the width of gaps between such pairs of plain cigarettes at least equals but preferably exceeds the length of a filter rod section of double unit length.

The upper portion of the frame 10 supports a magazine or hopper 4 for a supply of parallel filter rod sections of six times unit length. The open lower end of the magazine 4 is located above a portion of a rotary drum-shaped severing conveyer 6 having flutes which receive discrete filter rod sections of six times unit length and transport them past two rapidly rotating disk-shaped knives 7 which convert each filter rod section of six times unit length into a group of three coaxial filter rod sections of double unit length. Each filter rod section of a group is transferred onto one of three rotary drum-shaped staggering conveyors 8 (only one shown) which transport the respective sections of double unit length through different distances and/on at different speeds so that they convert each group into an array of three filter rod sections which are located one behind the other, as considered in the circumferential direction of the illustrated conveyor 8. The thus staggered filter rod sections of double unit length are transferred into successive flutes of a rotary drum-shaped conveyor 9 which cooperates with two stationary cams 9*a* (one shown) to shift at least two filter rod sections of a group axially in order to assemble the filter rod sections into a single row wherein each preceding section is in exact alignment with the next-following section. The shuffling conveyor 9 transfers successive filter rod sections of the thus obtained single row into successive flutes of a rotary drum-shaped accelerating conveyor 11 which inserts a filter rod section of double unit length into each flute of the assembly conveyor 3 (at a transfer station TS) so that the section enters a space corresponding to the gap between the respective pair of coaxial plain cigarettes of unit length. The thus obtained groups of rod-shaped articles (each such group contains two plain cigarettes of unit length and a filter rod section of double unit length therebetween) are caused to move between two stationary cams 3*a* (one shown) which move one or both cigarettes of each group axially toward the respective filter rod section so that the inner end faces of both plain cigarettes abut against the respective end faces of the associated filter rod section of double unit length. The thus shortened groups are thereupon transferred into successive flutes of a rotary drum-shaped transfer conveyor 12. In the machine of FIG. 1, the transfer station TS is located ahead of the locus of transfer of pairs of plain cigarettes into the flutes of the conveyor 3 because the latter rotates clockwise.

The frame 10 further supports a bobbin 14 for a running web 13 of stiff paper, imitation cork, lightweight cardboard or other suitable wrapping material. The web 13 is drawn off the bobbin 14 by an advancing roll 16 which cooperates with two idler rolls 38, 39 (see FIG. 2) and causes the web to move past a curling device 17 and on toward a rotary applicator 18*a* forming part of a paster 18. The applicator 18*a* coats one side of the web 13 with a suitable adhesive, and the leader of the web 13 is attracted to the peripheral surface of a rotary suction drum 19 which cooperates with the blades of a rotary knife 21 to sever the leader of the web 13 at regular intervals whereby the web yields a succession of adhesive-coated uniting bands.

The leader of a fresh web 113 which is stored on a fresh bobbin 114 is held in a position of readiness in a splicing device SD which is actuated shortly prior to expiration of the supply of web 13 on the bobbin 14 so as to attach the leader of the fresh web 113 to the adjacent portion of the running web 13 and to sever the web 13 from the material on the bobbin 14 immediately behind the thus obtained splice. Reference may be had to commonly owned U.S. Pat. No. 3,749,634 granted July 31, 1973 to Krause which discloses a splicing device capable of being used in the filter cigarette making machine of FIG. 1.

The suction drum 19 applies successive adhesive-coated uniting bands to successive groups of rod-shaped articles in the flutes of the transfer conveyor 12 in such a way that each uniting band contacts the respective filter rod section of double unit length and the adjacent inner portions of the corresponding plain cigarettes of unit length.

Such groups (each of which carries a uniting band) are thereupon transferred onto a rotary drum-shaped wrapping conveyor 22 which cooperates with a rolling device 23 (e.g., a device of the type disclosed in the commonly owned U.S. pat. No. 3,483,873 or 3,527,234 to Hinzmann) to convolute the uniting bands around the respective filter rod sections and the adjacent end portions of plain cigarettes of unit length and to thus convert each group into a filter cigarette of double length. The cigarettes of double length are transferred into successive flutes of a rotary drum-shaped drying conveyor 24 which transfers the cigarettes into successive flutes of a rotary drum-shaped severing conveyor 26 cooperating with a rotary disk-shaped knife 26*a* to sever each filter cigarette of double unit length midway between its ends and to thus convert each such cigarette into a pair of coaxial filter cigarettes of unit length. The knife 26*a* severs each filter cigarette of double unit length midway across the convoluted uniting band so that each filter cigarette of unit length consists of a plain cigarette of unit length, a filter rod section of unit length, and a convoluted uniting band which completely surrounds the filter rod section of unit length and the adjacent end portion of the plain cigarette.

The severing conveyor 26 may be associated with or may form part of an ejecting device for defective or presumably filter cigarettes of double unit length. For example, the ejecting device which includes or is associated with the severing conveyor 26 may be designed to automatically segregate those filter cigarettes which are produced during starting of the filter cigarette making machine and which are, or are likely to be, defective.

The severing conveyor 26 delivers pairs of coaxial filter cigarettes of unit length to a first rotary drum-shaped conveyor 27 of an inverting or tip-turning device 29 which is preferably constructed and assembled in a manner as disclosed in the commonly owned U.S. Pat. No. 3,583,546 granted June 8, 1971 to Koop. The tip-turning device 29 includes a further rotary drum-shaped conveyor 28 whose flutes carry a single row of filter cigarettes of unit length (the filter rod sections of all filter cigarettes forming this single row face in the same direction) and deliver such filter cigarettes to successive flutes of a rotary drum-shaped testing conveyor 31 forming part of a device for monitoring the condition of wrappers of filter cigarettes of unit length and for producing signals which are used for segregation of filter cigarettes with defective wrappers. The defects may be due to holes in wrappers, to opening of seams of the wrappers for the fillers of plain cigarettes, to opening of seams of the wrappers of filter rod sections, or to improper rolling of adhesive-coated uniting bands on the wrapping conveyor 22. The ejection of filter cigarettes with defective wrappers can take place during transport in the flutes of a rotary drum-shaped transfer conveyor 32 which follows the testing conveyor 31 and may form part of a second monitoring device which detects the mass or quantity of tobacco particles in the tobacco-containing end portions of filter cigarettes of unit length (i.e., in those end portions of filter cigarettes which are remote from the respective filter rod sections of unit length). The conveyor 32 delivers satisfactory filter cigarettes of unit length onto the upper stretch of an endless belt conveyor 36 whereon the cigarettes are braked by a roll 33 and which serves to transport filter cigarettes to a tray filling station, to a pneumatic conveyor, to storage, or directly into a packing machine, not shown. The reference character 34 denotes a roll which cooperates with the braking roll 33 and may constitute a pulley for the illustrated end turn of the belt conveyor 36.

The prime mover PM which drives the moving parts of the filter cigarette making machine (and which preferably also drives the moving parts of the cigarette rod making machine including the row forming conveyor 1) can constitute a variable-speed electric motor or it may comprise a constant-speed motor which drives the moving parts of the two machines through the medium of a variable-speed transmission. The machine of FIG. 1 is started with a certain delay following starting of the cigarette rod making machine, for example, when the first plain cigarettes of unit length begin to enter the flutes of the row forming conveyor 1.

Figure 2:
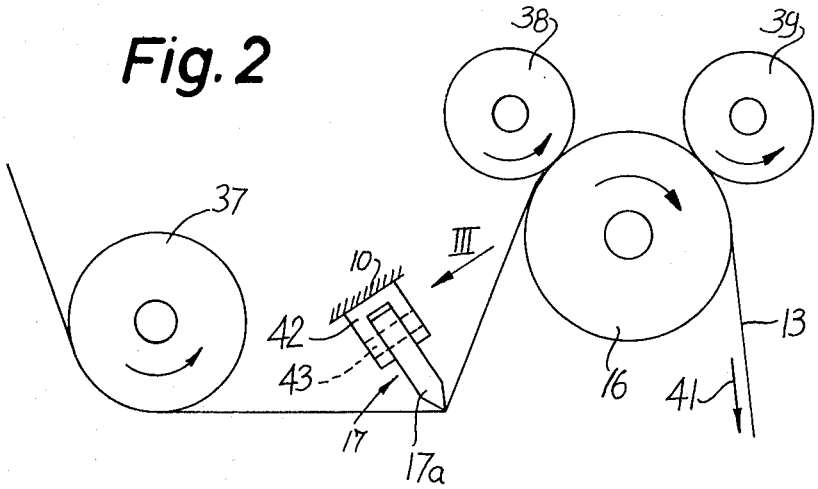
FIG. 2 is an enlarged elevational view of that portion of the filter cigarette making machine which is surrounded by the phantom-line circle II shown in FIG. 1.

FIG. 2 shows that the curling device 17 is mounted between the advancing roll 16 and a guide roll 37 and has an elongated web-contacting or web-engaging member 17*a* which extends into the path of movement of the web 13. The idler rolls 38, 39 are biased against the advancing roll 16 so that the web 13 advances at the peripheral speed of the roll 16 (whose speed may be changed by the prime mover PM or by the aforementioned variable speed transmission of the prime mover). The member 17*a* resembles a wedge and extends transversely of the path for the web 13 between the rolls 37 and 16. The relatively sharp edge of the member 17*a* bears against that side of the web 13 which is to be coated with adhesive by the applicator 18*a* of the paster 18. The direction of lengthwise movement of the web 13 is indicated by the arrow 41.

Figure 3:
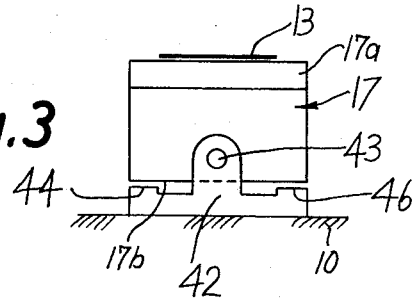
FIG. 3 is a view of the supporting and curling devices in the apparatus of FIG. 2, substantially as seen in the direction of arrow III shown in FIG. 2.

Referring to FIG. 3, the curling device 17 is tiltable on a pivot 43 which is mounted in or forms part of a bifurcated supporting device 42 secured to the frame 10 of the filter cigarette making machine. The pivot 43 is parallel to the direction of lengthwise movement of the web 13 and extends across the space between the two arms or legs of the bifurcated supporting device 42. Thus, the axis of the pivot 43 is normal to the member 17*a* and this pivot is preferably located midway or substantially midway between the ends of the member 17*a* (and hence substantially midway between the marginal portions of the web 13). The rear end face 17*b* of the curling device 17 can abut against one or the other of two stops 44, 46 which are provided on the supporting device 42 and serve as a means for limiting the extent of pivotal movement of the member 17*a* about the axis of the pivot 43. The stops 44,46 further insure that the curling device 17 cannot interfere with rapid and convenient threading of the leader of a fresh web through the filter cigarette making machine. However, the clearance between the rear end face 17*b* and the stop 44 and/or 46 is sufficient to enable the member 17*a* to turn about the axis of the pivot 43 to an extent which is necessary to insure uniform distribution (or the absence) of internal stresses in those increments of the web 13 which advance beyond the curling station. The pivoting of curling device 17 about the axis of the pivot 43 takes place in response to unequal distribution of web pressure lengthwise of the member 17*a*, and such pivoting promotes the equalization of web pressure. The curling device 17 is pivotable in a plane which is normal to the path for the web 13.

The reasons for uneven pressure with which the web bears against the edge portions of a fixedly mounted curling device and the advantages of the movably mounted curling device 17 are disclosed in detail in the aforementioned copending application Ser. No. 504,757 of Hinzmann.

Figure 4:
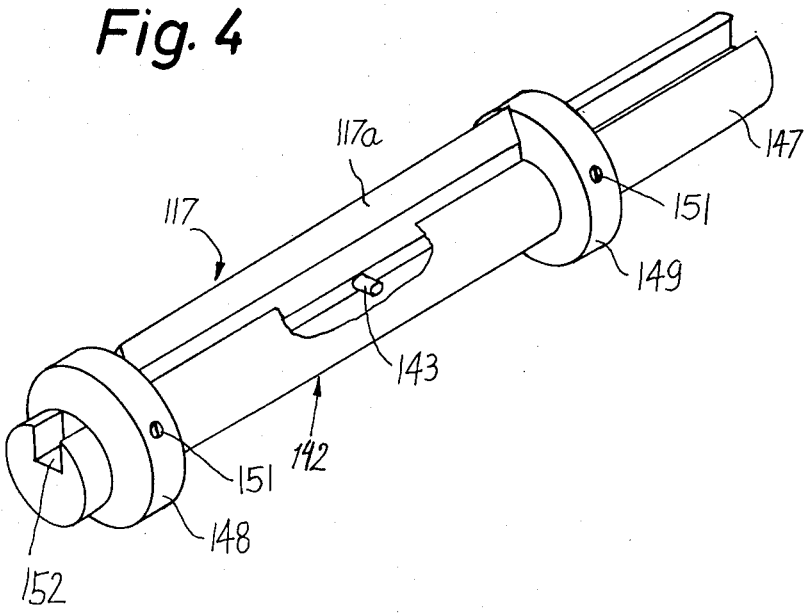
FIG. 4 is a perspective view of a modified supporting device for the curling device.

FIG. 4 shows a modified supporting device 142 having a cylindrical rod 147 and two spaced-apart sleeves 148, 149 secured to the rod 147 by screws 151 or other suitable fasteners. The rod 147 has a longitudinally extending groove 152 for a tiltable blade-like curling device 117 which includes an elongated edge portion or web-engaging member 117*a*. A pivot 143 which extends through registering holes in the rod 147 and in the rear portion of the curling device 117 enables the curling device to pivot or turn in the groove 152 between the sleeves 148 and 149. The bottom surface of the groove 152 constitutes a stop which limits the extent of pivotal movement of the curling device 117 and its member 117*a* when the latter is engaged by a running web, not shown. That end portion of the rod 147 which extends outwardly beyond the sleeve 149 can be inserted into and secured in a hole or socket of the frame 10. The groove 152 confines the curling device 117 to pivotal movement in a plane which is normal to the axis to the pivot 143 and to the path of movement of the web.

Figure 5:
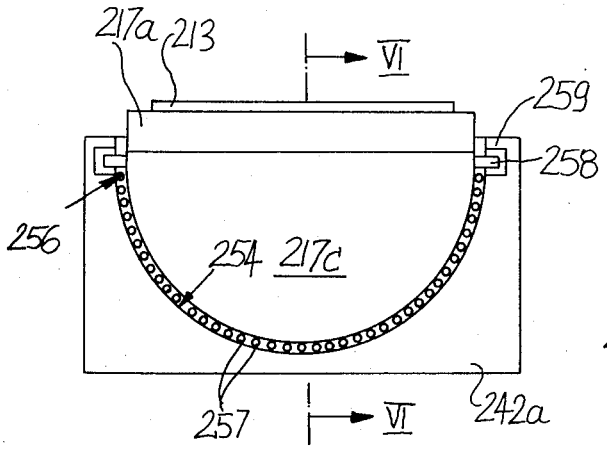
FIG. 5 is a longitudinal sectional view of a further supporting device and a side elevational view of the associated curling device.
Figure 6:
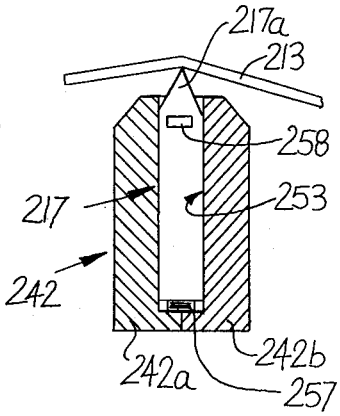
FIG. 6 is a sectional view as seen in the direction of arrows from the line VI—VI of FIG. 5.

The supporting device 242 of FIGS. 5 and 6 has two mirror symmetrical halves or sections 242*a*, 242*b* which are connected to each other by screws or the like, not shown. The sections 242*a*, 242*b* define a socket 253 bounded by a concave surface 254. The curling device 217 has an elongated web-contacting or web-engaging member 217*a* and a projection or rear portion 217*c* bounded by a convex surface 256 which is adjacent to the concave surface 254. Rolling elements 257 between the surfaces 254, 256 reduce friction when the member 217*a* is tilted by the running web 213. The ends of the curling device 217 have projections or lugs 258 which extend, with a certain amount of clearance, into adjacent recesses 259 of the supporting device 242 whereby the surfaces bounding the recesses 259 limit the extent of movement of the curling device 217. The socket 253 confines the curling device 217 to movements in a plane which is normal to the path of the running web 213. The supporting device 242 is removably mounted in the frame of the filter cigarette making machine.

Figure 7:
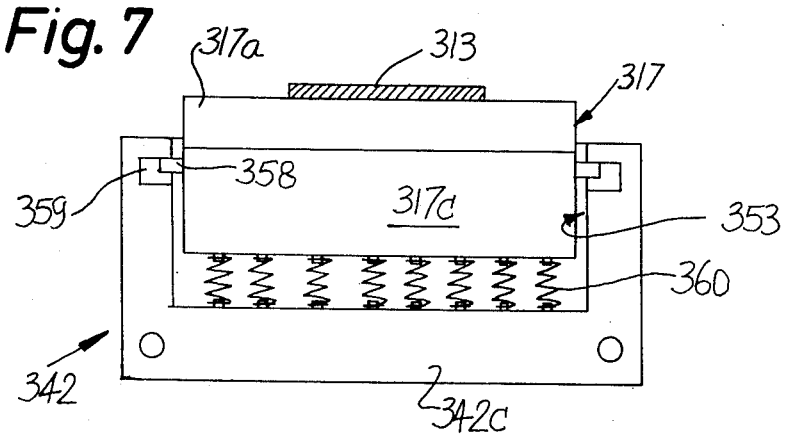
FIG. 7 is a sectional view of still another supporting device and a side elevational view of the associated curling device.

The supporting device 342 of FIG. 7 has a socket 353 for the main portion 317*c* of a blade-like curlng device 317 including an elongated web-contacting or web-engaging member 317*a*. The base 342*c* of the supporting device 342 constitutes a retainer or back support for prestressed helical springs 360 which react against the supporting device 342 and bear against the underside of the main portion 317*c*. The lugs 358 and recesses 359 are functional equivalents of the lugs 258 and recesses 259 shown in FIGS. 5–6. The supporting device 342 can be assembled of two mirror symmetrical halves or sections, or of three or more sections.

The curling device 317 is not pivotable about a stationary or fixed pivot axis. When the pressure of web 313 lengthwise of the member 317*a* is not uniform, one or more springs 360 yield or expand so that the inclination of the curling device 317 with respect to the supporting device 342 changes. The curling device 317 can pivot about an axis which is located midway between the lugs 358 or closer to the one or the other lug. If desired, the main portion 317*c* can be affixed to the supporting device 342. The member 317*a* is then movable relative to the main portion 317*c* and the springs 360 or analogous biasing means are installed between the main portion 317*c* and member 317*a*.

The main portion 317*c* and the retainer 342*c* of FIG. 7 may carry guide pins for the adjacent end convolutions of the springs 360.

The curling device preferably consists of steel or another suitable metallic material. However, certain types of synthetic plastic material can be used instead of or as a coating for metallic curling devices.

Figure 8:
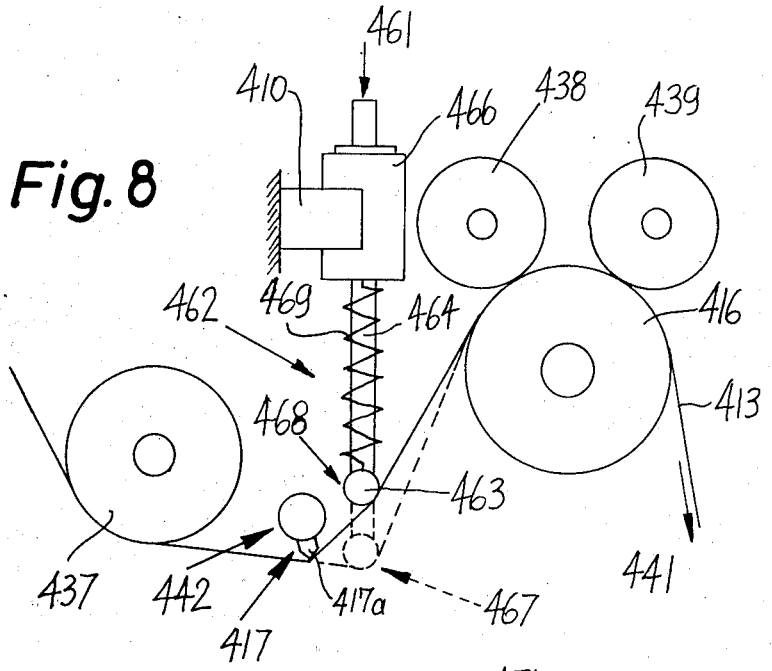
FIG. 8 is a schematic elevational view of an apparatus which embodies the structure of FIG. 2 and comprises one form of the safety device.

FIG. 8 illustrates a rod-like element 463 which can be moved between an operative position 467 (indicated by broken lines) and an inoperative position 468 (indicated by solid lines) to respectively bodily disengage the web 413 from and to allow, the web to engage with the web-contacting member 417*a* of a curling device 417 which is identical with or closely resembles the curling device 117 of FIG. 4. The disengaging element 463 is moved to the operative position 467 when the speed of the web 413 changes, i.e., when the circumstances are such that the member 417*a* would be likely to cause the web to break. The member 417*a* is pivotable about an axis which is parallel to the plane of FIG. 8 and the curling device 417 is mounted between a guide roll 437 and an advancing roll 416 which cooperates with two spring-biased ider rolls 438, 439 to move the web 413 in the direction, indicated by arrow 441. The supporting device for the curling device 417 is shown at 442.

The disengaging element 463 forms part of a safety device 462 which further includes an electromagnet 466 mounted on the frame 410 of a filter cigarette making machine. The reciprocable armature 464 of the electromagnet 466 has an elongated motion transmitting portion which is separably connected to or made integral with the disengaging element 463. A helical spring 469 or analogous biasing means is provided to urge the disengaging element 463 to the inoperative position 468. Energization of the electromagnet 466 entails a movement of the disengaging element 463 to the operative position 467 (see the arrow 461). The axis of the disengaging element 463 is normal to the plane of FIG. 8, i.e., the element 463 extends transversely of the web 413 and can engage that side of the web which is normally engaged by the member 417*a*. of the curling device 417.

Figure 9:
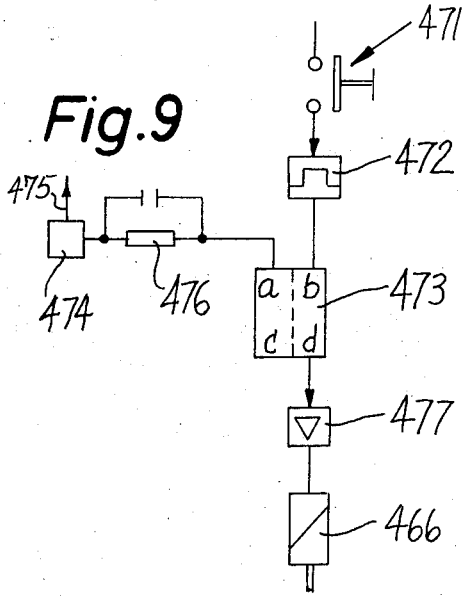
FIG. 9 is a diagrammatic view of control means for the safety device of FIG. 8.

The control unit for the safety device 462 is shown in FIG. 9. This control unit comprises an electric switch 471 which, when closed, causes a pulse shaper 472 to transmit a signal to the input *b* of a signal storing circuit 473. The outpout *d* of the circuit 473 then energizes the electromagnet 466 of the safety device 462 by way of an amplifier 477. The signal erasing input *a* of the circuit 473 is connected with a pulse generator 474 through the medium of a time-delay circuit 476. The switch 471 is closed for the purpose of or simultaneously with starting of a cigarette rod making machine serving to supply the plain cigarettes of unit length to the filter cigarette making machine which embodies the curling device 417 of FIG. 8. The pulse generator 474 is actuated subsequent to closing of the switch 471, and the time-delay circuit 476 transmits a signal with a delay which is sufficient to enable the filter cigarette making machine to operate at normal speed when the input *a* of the signal storing device 473 receives a signal to deenergize the electromagnet 466. The parts 472, 473, 474, 476 and 477 are of known design.

The pulse generator 474 and the time-delay device 476 can be said to constitute a means for monitoring the speed of the advancing roll 416 of FIG. 8 because the input *a* of the circuit 473 receives an erasing signal when the speed of the roll 416 (and hence the speed of the web 413) increases from zero speed to one of a predetermined range of speeds at which the web 413 can be flexed by the member 417*a* without a pronounced danger of web breakage.

The operation of the production line which embodies the safety device 462 and the control unit of FIG. 9 is as follows:

In order to start the production line, an attendant closes the starter switch 471. The closing of switch 471 results in starting of the prime mover PM which drives the filter cigarette making machine as well as the aforementioned cigarette rod making machine (see the row forming conveyor 1 in FIG. 1) which supplies pairs of plain cigarettes of unit length to the filter cigarette making machine. The pulse shaper 472 transmits to the input *b* of the signal storing circuit 473 a signal of predetermined shape whereby the output *d* of the circuit 473 transmits a continuous signal which is amplified by 477 and energizes the electromagnet 466. Consequently, the armature 464 moves downwardly, as viewed in FIG. 8 (see the arrow 461), and the disengaging element 463 is moved to the operative position 467 to thereby insure that the web 413 cannot engage and cannot be flexed and eventually damaged or broken by the relatively sharp member 417*a* of the curling device 417 while the web is idle and/or while the web is being accelerated from zero speed to normal operating speed. Such normal operating speed is reached with a delay after the first plain cigarette or cigarettes reach the row forming conveyor 1 of FIG. 1. The pulse generator 474 may constitute a detector (e.g., a photoelectric cell) which monitors the flutes of the conveyor 1 for the presence or absense of plain cigarettes of unit length and transmits a signal in response to detection of the foremost plain cigarette. The prime mover PM starts to move the moving parts of the cigarette rod making machine ahead of the filter cigarette making machine, and the signal from the pulse generator 474 can be used (see the arrow 475) to start the moving parts of the filter cigarette making machine including the paster 16 of FIG. 1, the severing conveyor 6 of FIG. 1, the aligning conveyors 2 of FIG. 1, the advancing roll 416 of FIG. 8, and others. The acceleration of moving parts of the filter cigarette making machine takes up a certain interval of time during which the speed of the web 413 increases from zero speed to a normal operating speed. The web 413 is especially likely to break during such acceleration from zero speed to normal speed, and its engagement with the member 417*a* of the curling device 417 would greatly enhance the likelihood of breakage. Therefore, the time-delay circuit 476 of FIG. 9 is adjusted in such a way that it transmits (to the input *a* of the signal storing circuit 473) a signal with a delay which is sufficient to insure that the signal at the output *d* of the circuit 473 disappears when the web 413 is already running at normal speed.

The spring 469 of FIG. 8 contracts and pulls the disengaging element 463 to the inoperative position 468 as soon as the electromagnet is deenergized whereby the web 413 moves into engagement with and is curled by the member 417*a*. The member 417*a* not only curls but also reduces the stiffness of the web 413 so that the latter can be readily converted into a succession of uniting bands which are thereupon converted into tubes serving to secure filter rod sections of double unit length to pairs of plain cigarettes of unit length in a manner as described in connection with FIG. 1.

FIG. 10 shows a curling device 517 mounted in a supporting device 542 in a manner as shown for the devices 117, 142 of FIG. 4. The safety device of FIG. 10 comprises a shaft 578 which can turn the supporting device 542 stepwise in a counterclockwise direction, as viewed in FIG. 10 (see the arrow 561). The shaft 578 can be rotated stepwise by an electric motor 783 which is shown in FIG. 12. The reference character 579 denotes a splice in the web 513, and the purpose of the control unit of FIG. 12 is to insure that the curling device 517 is moved from the normal position (shown by solid lines) to the idle or disengaged position 517A (indicated by broken lines) before the splice 579 reaches the curling station. The web 513 than moves to the position 513A (indicated by broken lines) and the splice 579 slides, without any damage thereto, along the preferably cylindrical peripheral surface 542A of the supporting device 542. The web 513 is advanced by a system of rolls corresponding to the rolls 416, 438, 439 shown in FIG. 8.

The supporting device 642 of FIG. 11 carries two pivotable curling devices 617 and 617′ which are mounted diametrically opposite each other. The safety device comprises a shaft 678 which can rotate the supporting device 642 stepwise (arrow 661), always through angles of 90 degrees. The web 613 has a splice 679 which is in the process of approaching the curling station. Before the splice 679 reaches the web engaging memeber 617*a* of the curling device 617, the shaft 678 is caused to rotate through 90° so that the splice 679 bypasses the curling device 617 and the supporting device 642 or slides along the cylindrical peripheral surface 642A. The shaft 678 is thereupon rotated through 90° so that the web 613 is engaged by the member 617*a'* of the other curling device 617'. The curling device 617' thereupon remains in engagement with the web 613 until shortly before the next splice or another defective web portion reaches the curling station. The procedure is then repeated with the exception that two angular movements of the shaft 678 result in reengagement between the web 613 and the curling device 617 (after the last-mentioned splice or other defective web portion has been advanced beyond the curling station).

If desired, the supporting device 642 or 542 can carry more than two curling devices, as long as it can be moved to at least one angular position in which a splice or another relatively weak (defective) portion of the web can bypass the curling devices. For example, and if the diameter of the supporting device 642 is sufficiently large, this device can support three equally spaced curling devices and the shaft 678 is then caused to rotate throug angles of 60°, once before and once subsequent to transport of a splice 679 past the curling station.

The control unit of FIG. 12 is assumed to be used to start and stop the motor 783 for the shaft 578 of FIG. 10. This control unit comprises a detector 773 (e.g., a suitable capacitor) which monitors the running web 513 and transmits a signal in response to detection of a splice 579. Such signal is then transmitted to the input *a* of a signal storing circuit 774 which further comprises a signal erasing input *b* and an output *c* connected to one input of an AND-gate 776. The other input of the gate 776 is connected with and receives a succession of signals from the switch 772 of a pulse generator further having a disk 771 with an annulus of permanent magnets 771*a* and being driven in synchronism with moving parts of the filter cigarette making machine embodying the structure of FIG. 10. When the output *c* of the circuit 774 begins to transmit a continuous signal in response to detection of splice 579 by the capacitor 773, the output of the AND-gate 776 transmit a succession of signals to the corresponding input of a counter circuit 777. The AND-gate 776 transmits a signal whenever its left-hand input receives a signal from the switch 772 (which produces signals when approached by successive permanent magnets 771*a* of the disk 771) while the righthand input of the gate 776 receives a continuous signal from the output *c* of the circuit 776. The counter circuit 777 must receive a predetermined number of signals before its output transmits a signal to the input *a* of a second signal storing circuit 778 whose output *c* transmits a continuous signal to the right-hand input of a second AND-gate 779) the left-hand input of which receives signals from the switch 772. The output of the gate 779 then transmits a series of signals to an amplifier 781 for the motor 783 of the safety device and to one input of a second counter circuit 782. The output of the counter circuit 782 is connected with a second (resetting) input of this counter circuit and to the signal erasing input *b* of the circuit 778. The output of the counter circuit 777 is connected to a second (resetting) input of this counter circuit and to the signal erasing input *b* of the circuit 774.

The detector 773 monitors the running web 513 upstream of the curling station (see the solid-line position of the curling device 517 in FIG. 10). Thus, the oncoming splice 579 is detected and the input *a* of the signal storing circuit 774 of FIG. 12 receives a signal before the respective splice 579 reaches the web-contacting member 517*a* of the curling device 517. The disk 771 is driven in synchronism with the moving parts (e.g., with the advancing roll 16) of the filter cigarette making machine and transmits to the AND-gates 776, 779 a predetermined number of signals before the splice 579 advances from the detector 773 to the curling station (provided that the web 513 is transported at the normal speed). The switch 772 may constitute an inductance which is adjacent to the path of but does not come into contact with successive permanent magnets 771*a*.

The output *c* of the circuit 774 transmits a continuous signal as soon as its input *a* receives a signal from the detector 773. Therefore, the gate 776 begins to transmit a series of signals at the rate at which its left-hand input receives signals from the switch 772. Such signals are transmitted to the counter circuit 777 which transmits a signal to the input *a* of the signal storing circuit 778 shortly before the freshly detected splice 579 reaches the curling station. The transmission of a signal to the input *a* results in transmission of a continuous signal from the output *c* of the signal storing circuit 778, and such signal is transmitted to the right-hand input of the AND-gate 779. When the left-hand input of this gate receives the next signal from switch 772, it causes the amplifier 781 to start the motor 783 whereby the latter rotates the shaft 578 and supporting device 542 of FIG. 10 through 90° (see the arrow 561 in FIG. 10). Consequently, the curling device 517 is moved out of the way and the oncoming splice 579 can slide along the cylindrical peripheral surface 542A of the supporting device 542. The motor 783 is started again in response to transmission of three additional signals to the left-hand input of the AND-gate 779 so that the shaft 578 performs three additional angular movements (always through 90°) and thereby returns the curling device 517 to the web-changing position of FIG. 10. However, in the meantime, the splice 579 has been advanced beyond the curling station so that the member 517*a* can safely engage the web 513 which is thereby moved back from the position 513A to the solid-line position of FIG. 10. The fourth signal from the output of the gate 779 causes the output of the counter circuit 782 to transmit a resetting signal to the second input of this circuit (i.e., the counter circuit 782 is reset to zero) and to the erasing input *b* of the circuit 778 so that the signal at the output *c* of the circuit 778 disappears and the motor 783 remains idle after the curling device 517 reassumes the solidline position of FIG. 10. The signal at the output *c* of the circuit 774 disappears earlier, namely, in response to a signal from the output of the counter circuit 777 to the input *a* of the signal storing circuit 778. The signal from the output of the counter circuit 777 resets this circuit to zero simultaneously with transmission of such signal to the erasing input *b* of the circuit 774.

The angular displacement of the shaft 578 of the safety device is such that this shaft must complete *n* angular movements before the curling member 517 reassumes the solid-line position of FIG. 10, whereby *n* denotes a whole number exceeding one. In the embodiment of FIGS. 10 and 12, *n* equals four because the shaft 578 is assumed to rotate through angles of 90°. It is equally possible to construct the control unit of FIG. 12 in such a way that a first signal from the AND-gate 779 to the amplifier 781 results in rotation of the shaft 578 through 180° and the second signal from gate 779 again results in rotation of the shaft 578 through 180°. The counter circuit 782 is then adjusted to reset itself to zero in response to two successive signals from the gate 779 and to simultaneously transmit an erasing signal to the input *b* of the signal storing circuit 778. The number of angular movements which the shaft 578 must perform in order to move the curling device 517 from and back into engagement with the web 513 can be reduced to one if the speed at which the shaft 578 is rotated by the motor 783 is sufficiently high to insure that the curling device 517 is moved out of the way before the splice 579 reaches the curling station, i.e., that the angular movement of shaft 578 through 360° is invariably completed after the splice 579 has advanced beyond the curling station. Thus, if the amplifier 781 receives a signal in good time before the splice 579 reaches the curling station, the counter circuit 782 can be omitted and the output of the gate 779 can be connected directly with the signal erasing input *b* of the circuit 778 because a single signal from the gate 779 suffices to effect a rotation of shaft 578 through 360°, provided that the speed at which the shaft 578 is rotated is sufficiently low to insure that the oncoming splice will not engage the curling device 517 but that the speed is sufficiently high to insure that the curling device 517 will reengage the web 513 (behind the splice) without an excessive delay which would allow a relatively long portion of the web to advance past the supporting device 542 without any curling.

If the motor 783 of FIG. 12 is to drive the shaft 678 of FIG. 11, the aforementioned number *n* equals two because the supporting device 642 carries two curling devices 617, 617′ (it being assumed that each starting of the motor 783 results in rotation of the shaft 678 through 90°. If the motor 783 can drive the shaft 678 at a predetermined optimum speed, the counter circuit 782 can be omitted and the motor 783 simply rotates the shaft 678 through 180° in response to each signal from the gate 779. The shaft 678 then moves the curling device 617 out of the way of an oncoming splice 679 and continues to rotate counterclockwise in order to move the other curling device 617′ to the curling station. If the supporting device carries more than two curling devices, the maximum angle through which the supporting device can be rotated by the motor 783 or an analogous rotating means is 360/*m* wherein *m* is the number of curling devices.

An advantage of the control unit of FIG. 12 is that it can actuate the safety device when the web is advanced at a constant speed or while the speed of the web varies.

The control unit of FIG. 12 can be used independently of or together with the control unit of FIG. 9. Thus, if the production line embodies two control units, the disengaging element 463 can be moved to operative position prior to and during starting of the filter cigarette making machine, and the supporting device 442 of FIG. 8 (which is then preferably rotatable in a manner as described for the supporting device 542 or 642) is then rotated whenever a splice or another detectable defective web portion approaches the curling station. However, it is equally within the purview of the invention to omit the motor 783 and to use the amplifier 781 to energize the electromagnet 466 whenever a splice approaches the curling station; the splice is then caused to bypass the curling device 417 of FIG. 8 by travelling along the cylindrical peripheral surface of the disengaging element 463 (which may constitute an idler roller to reduce friction with the moving web). In such constructions, the supporting device 442 need not rotate at all because the disengaging device 463 moves to the operative position 467 of FIG. 8 whenever the web 413 is being accelerated as well as when a splice approaches the curling station. Alternatively, the safety device 462 can be omitted in its entirety if the amplifier 477 is connected with the motor 783 of FIG. 12 to cause the curling device 517 to rotate and to thereby move out of the way not only while the web is being acceleratred but also while a splice approaches the curling station.

It is further clear that the control units of FIGS. 9 and 12 can be used for actuation of safety devices in other types of machines or production lines, e.g., in machines which make simple or multiple-layer packs for arrays of cigarettes, cigars, cigarillos or other types of smokers' products. Such machines often employ webs which must be subdivided into discrete blanks. Also, a curling device, a safety device and the control unit of FIG. 9 and/or 12 can be used with equal advantage in machines which convert webs into wrappers of simple or composite filter rod sections or in machines wherein webs are wound onto cigar or cigarillo fillers. Still further, a curling device, a safety device and one or more control units for the safety device can be used in certain types of cigarette, cigar or cigarillo rod making machines to flex webs of cigarette paper, reconstituted tobacco or the like, or in machines which produce bobbins for use in filter cigarette making or the like machines.

Without further analysis, the foregoing will so fully reveal the gist of the present invention that others can, by applying current knowlege, readily adapt it for various applications without omitting features which fairly constitute essential characteristics of the generic and specific aspects of our contribution to the art and, therefore, such adaptations should and are intended to be comprehended within the meaning and range of equivalence of the claims.

What is claimed as new and desired to be protected by Letters Patent is set forth in the appended claims.

1. Apparatus for manipulating an elongated flexible web having spaced-apart defective portions, particularly a web which is being withdrawn from a bobbin and is utilized in the manufacture or processing of smokers' products, comprising means for advancing the web lengthwise along a predetermined path, a supporting device adjacent to one side of said path; at least one curling device mounted in said supporting device and having an elongated web engaging member extending substantially transversely of said path and normally engaging one side of the web so that successive increments of the web are flexed as a result of engagement with said member; a safety device actuatable to disengage the web from said curling device; and control means for actuating said safety device, comprising means for monitoring the web ahead of said curling device to detect said defective portions of the web, and means for effecting the actuation of said safety device in response to detection of said defective portions by said monitoring means so that such defective portions are not engaged by said member.

2. Apparatus as defined in claim 1, wherein said web engaging member of said curling device normally extends into said path so that said one side of the web in said path exerts pressure against said member, at least said member of said curling device being movable with respect to said supporting device in response to unequal distribution of web pressure lengthwise of said member to thereby promote the equalization of web pressure lengthwise of said member.

3. Apparatus as defined in claim 1, wherein said safety device comprises means for rotating said supporting and curling devices about an axis extending substantially transversely of said path between a first position in which said member engages the web and at least one second position in which said member is disengaged from the web.

4. Apparatus as defined in claim 3, wherein said rotating means comprises a motor for rotating said supporting and curling devices in stepwise fashion.

5. Apparatus as defined in claim 2, further comprising means for limiting the extent of movement of said web engaging member with respect to said supporting device.

6. Apparatus as defined in claim 1, wherein said safety device comprises means for moving said curling device from engagement with the web in response to actuation by said control means.

7. Apparatus as defined in claim 1, wherein said defective portions include splices.

8. Apparatus as defined in claim 1, wherein said control means further comprises means for deactivating said safety device after a predetermined interval of activation which is long enough to insure that a detected defective portion of the web has advanced beyond such curling device.

9. Apparatus for manipulating an elongated flexible web, particularly a web which is being withdrawn from a bobbin and is utilized in the manufacture or processing of smokers' products, comprising means for advancing the web lengthwise along a predetermined path; a supporting device adjacent to one side of said path; at least one curling device mounted in said supporting device and having an elongated web engaging member extending substantially transversely of said path and normally engaging one side of the web so that successive increments of the web are flexed as a result of engagement with said member; a safety device actuatable to disengage the web from said curling device; and control means for actuating said safety device, said safety device comprising means for bodily disengaging the web from said curling device in response to actuation by said control means.

10. Apparatus as defined in claim 9, wherein said means for bodily disengaging the web comprises an element which normally assumes an inoperative position and means for shifting said element to an operative position of engagement with the web in response to actuation by said control means, the web engaging said member of said curling device in said inoperative position of said element and the web being disengaged from said member in said operative position of said element.

11. Apparatus as defined in claim 10, wherein said means for shifting said element comprises an electromagnet.

12. Apparatus for manipulating an elongated flexible web, particularly a web which is being withdrawn from a bobbin and is utilized in the manufacture or processing of smokers' products, comprising means for advancing the web lengthwise along a predetermined path; means for operating said advancing means at a plurality of speeds; a supporting device adjacent to one side of said path; at least one curling device mounted in said supporting device and having an elongated web engaging member extending substantially tranversely of said path and normally engaging one side of the web so that successive increments of the web are flexed as a result of engagement with said member; a safety device actuatable to disengage the web from said curling device; and control means for actuating said safety device, comprising means for monitoring the speed of said curling device; and control means for actuating said safety device when the monitored speed of the advancing means deviates from a predetermined speed range.

13. Apparatus as defined in claim 12, wherein said speeds include zero speed and a second range of speeds less than predetermined range.

14. Apparatus as defined in claim 13, wherein the acceleration of said advancing means from zero speed to said predetermined range takes up a predetermined interval of time and said monitoring means comprises a detector arranged to generate a signal in response to starting of said advancing means and means for operating said actuation effecting means to terminate the actuation of said safety device after elapse of said predetermined interval following the generation of said signal.

15. Apparatus for manipulating an elongated flexible web, particularly a web which is being withdrawn from a bobbin and is utilized in the manufacture or processing of smokers' products, comprising means for advancing the web lengthwise along a predetermined path; a supporting device adjacent to one side of said path; at least one curling device mounted in said supporting device and having an elongated web engaging member extending substantially transversely of said path and normally engaging one side of the web so that successive increments of the web are flexed as a result of engagement with said member, said member normally extending into said path so that said one side of the web in said path exerts pressure against said member, at least said member being movable with respect to said supporting device in response to unequal distribution of web pressure lengthwise of said member to thereby promote the equalization of web pressure lengthwise of said member, said supporting device comprising a pivot which is substantially normal to said member and said curling device being turnable about the axis of said pivot; a safety device actuatable to disengage the web from said curling device; and control means for actuating said safety device.

16. Apparatus as defined in claim 15, wherein said axis is located substantially midway between the ends of said web engaging member.

* * * * *

UNITED STATES PATENT OFFICE

CERTIFICATE OF CORRECTION

Patent No. 3,996,842 Dated December 14, 1976

Inventor(s) Klaus-Dieter EHLICH and Heinz-Christen LORENZEN

It is certified that error appears in the above-identified patent and that said Letters Patent are hereby corrected as shown below:

Foremost page, left-hand column, item [73], "Hauni-Werke Korber & Co., KG," should read --Hauni-Werke Körber & Co. KG,--.

Col. 1, line 31, "filters." should read --fillers.--;
line 45, "article." should read --articles.--;
line 55, "of" (second occurrence) should read --or--.

Col. 2, line 12, --a-- should be inserted after "and";
line 37, "smoker's" should read --smokers'--;
line 66, "manfunctioning" should read --malfunctioning--.

Col. 4, line 45, "and/on" should read --and/or--;
line 51, --shuffling-- should be inserted before "conveyor".

Col. 5, line 42, --end-- should be inserted after --inner--;
line 48, "pat." should read --Pat.--;
line 53, --unit-- should be inserted after "double" (both occurrences).

Col. 6, line 3, --defective-- should be inserted before "filter".

Col. 8, line 23, "curlng" should read --curling--.

Col. 9, line 2, the comma should be deleted after "direction".
line 20, the period should be deleted after "417a".

Col. 10, line 38, --466-- should be inserted after "electromagnet".

Col. 11, line 7, "memeber" should read --member--;
line 31, "throug" should read --through--;
line 50, --a-- should be inserted after "of";
line 51, "transmit" should read --transmits--;
line 57, "righthand" should read --right-hand--;
line 62, --then-- should be inserted before "transmits";
line 63, "779)" should read --779--.

UNITED STATES PATENT OFFICE

CERTIFICATE OF CORRECTION

Patent No. 3,996,842 Dated December 14, 1976

Inventor(s) Klaus-Dieter EHLICH and Heinz-Christen LORENZEN

It is certified that error appears in the above-identified patent and that said Letters Patent are hereby corrected as shown below:

Col. 12, line 49, "web-changing" should read --web-engaging--;

line 61, "solidline" should read --solid-line--.

Col. 13, line 46, "90°." should read --90°).--.

Col. 14, line 21, "acceleratred" should read --accelerated--;

line 40, "the" should be deleted.

Claim 1, line 6, the comma should be changed to a semicolon.

Claim 8, line 6, "such" should read --said--.

Claim 12, the line 17 should read --said advancing means and means for effecting the actuation of--.

Claim 13, line 3, --said-- should be inserted after "than".

Signed and Sealed this

Fifth Day of April 1977

[SEAL]

*Attest:*

RUTH C. MASON
*Attesting Officer*

C. MARSHALL DANN
*Commissioner of Patents and Trademarks*